US005829746A

United States Patent [19]

Pacella

[11] Patent Number: 5,829,746

[45] Date of Patent: Nov. 3, 1998

[54] INVESTMENT BOARD GAME

[76] Inventor: John P. Pacella, 2997 Rhineberry, Rochester Hills, Mich. 48309

[21] Appl. No.: 862,498

[22] Filed: May 23, 1997

[51] Int. Cl.[6] ..... A63F 3/00

[52] U.S. Cl. ..... 273/256

[58] Field of Search ..... 273/242, 243, 273/248, 249, 256, 278

[56] References Cited

U.S. PATENT DOCUMENTS

| | | | |
|---|---|---|---|
| 907,663 | 12/1908 | Williams . | |
| 1,541,707 | 6/1925 | Hanback . | |
| 1,587,391 | 6/1926 | McKee . | |
| 1,994,053 | 3/1935 | Sweet . | |
| 3,254,894 | 6/1966 | Kollmeyer et al. . | |
| 3,397,890 | 8/1968 | Newton . | |
| 3,804,419 | 4/1974 | Jackson . | |
| 4,378,942 | 4/1983 | Isaac . | |
| 4,431,195 | 2/1984 | Brand et al. . | |
| 4,588,192 | 5/1986 | Laborde . | |
| 4,674,748 | 6/1987 | Wismer . | |
| 4,840,382 | 6/1989 | Rubin . | |
| 4,871,177 | 10/1989 | Mock | 273/256 |
| 4,884,818 | 12/1989 | Fogarty . | |
| 4,902,020 | 2/1990 | Auxier . | |
| 4,930,789 | 6/1990 | Harris et al. | 273/256 |
| 4,932,668 | 6/1990 | Stewart | 273/256 |
| 4,934,707 | 6/1990 | Koster | 273/278 X |
| 4,948,145 | 8/1990 | Breslow . | |
| 4,991,853 | 2/1991 | Lott | 273/278 X |
| 5,009,429 | 4/1991 | Auxier . | |
| 5,100,140 | 3/1992 | Foy . | |
| 5,169,154 | 12/1992 | Borghi . | |
| 5,232,222 | 8/1993 | Deutch . | |
| 5,603,499 | 2/1997 | Jagosz . | |
| 5,709,384 | 1/1998 | Miller | 273/256 |

*Primary Examiner*—William E. Stoll
*Attorney, Agent, or Firm*—Harness, Dickey & Pierce, P.L.C.

[57] ABSTRACT

An investment board game is provided having various investments vehicles such as stocks, business deals, retirement savings, casino, lottery, and inheritance in addition to expenses such as taxes and assorted purchases. The board game can be played with multiple parties and includes the factor of risk taking, planning, skill and chance.

6 Claims, 3 Drawing Sheets

GAMEBOARD LAYOUT

GAMEBOARD LAYOUT

STOCK WHEEL

INVESTMENT BOARD GAME

BACKGROUND OF THE INVENTION

FIELD OF THE INVENTION

The present invention relates to a board game, and more particularly, to an investment board game having various investment vehicles such as stocks, business deals, retirement savings, casino, lottery, and inheritance in addition to expenses such as taxes and assorted purchases.

BACKGROUND AND SUMMARY OF THE INVENTION

The prior art is replete with board games, including board games in which the object is to accumulate the most valuable portfolio of various types of assets. Real estate and the stock market have been a favorite basis for such games. The participants engage in the trading of stocks and/or the purchasing of real estate. The appeal of these games is that they reflect a basic requirement for survival in a modern world governed by a monetary based economic system. In these games, players compete on a financial basis with gains and losses related to the acquisition of stocks and real estate and the improvement of property. The outcome of these games depend in large part upon chance and in lesser part upon the risk taking, skill, and planning of the players.

Accordingly, it is an objective of the present invention to provide an entertaining game which can be played by multiple parties and which includes the factors of risk taking, planning, skill, and chance. The object of the game is to be the first to turn a predetermined amount of discretionary income such as $250,000 into an objective amount such as $1 million. This is done through various investment vehicles such as stocks, business deals, retirement savings (401K-type), casino gambling, lottery, and inheritance. Players also may encounter expenses through taxes and assorted purchases.

According to one aspect of the present invention, a board game is provided including a game board having a track thereon with a series of playing positions, the playing positions representing various financial situations. A plurality of game pieces are used for movement by respective players along the track. Chance means, such as dice, are used by the players in turn to determine how far a player's game piece is to be moved forward. The series of playing positions on the game board include at least one "lottery play" position and at least one "lottery draw" position. The "lottery play" position provides a player who lands thereon an opportunity to purchase a lottery number for a chance at winning a prize jackpot. The "lottery draw" position represents a lottery drawings for all players who purchased a lottery number.

According to another aspect of the present invention, the series of playing positions also include at least one position for providing a player with an option for buying stocks. A purchase price for the stocks is provided on a stock wheel. The series of playing positions further includes at least one position for providing all players an option for selling stocks. The sale price for the stocks is determined by turning the stock wheel.

According to yet another aspect of the present invention, the series of playing positions include at least one position for providing a player with an opportunity to play a casino-type game.

According to yet another aspect of the present invention, the playing positions on the game board include at least one position with at least two corresponding sets of cards. The first set of cards each describe different investment opportunities and the second set of cards each described an outcome of an initial investment. A player who lands on the at least one position takes a card from the first set of cards and if the player purchases the investment property, the player takes the card from the second set of cards and waits until subsequently landing on a designated position in order to determine the outcome of the initial investment.

According to still another aspect of the present invention, at the start of the game, each player designates a contribution amount for contributing to a savings account each time the player passes a predetermined position on the game board. After a predetermined number of passes around the game board, the savings account matures to a predetermined multiple of the total contribution amount which is then credited to the player's account.

According to still another aspect of the present invention, a set of cards is provided which each include a financial gain obtained by an act that had been committed. The cards also provide a consequence that a player must incur for that act, if the player lands on a predetermined one of the playing positions.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
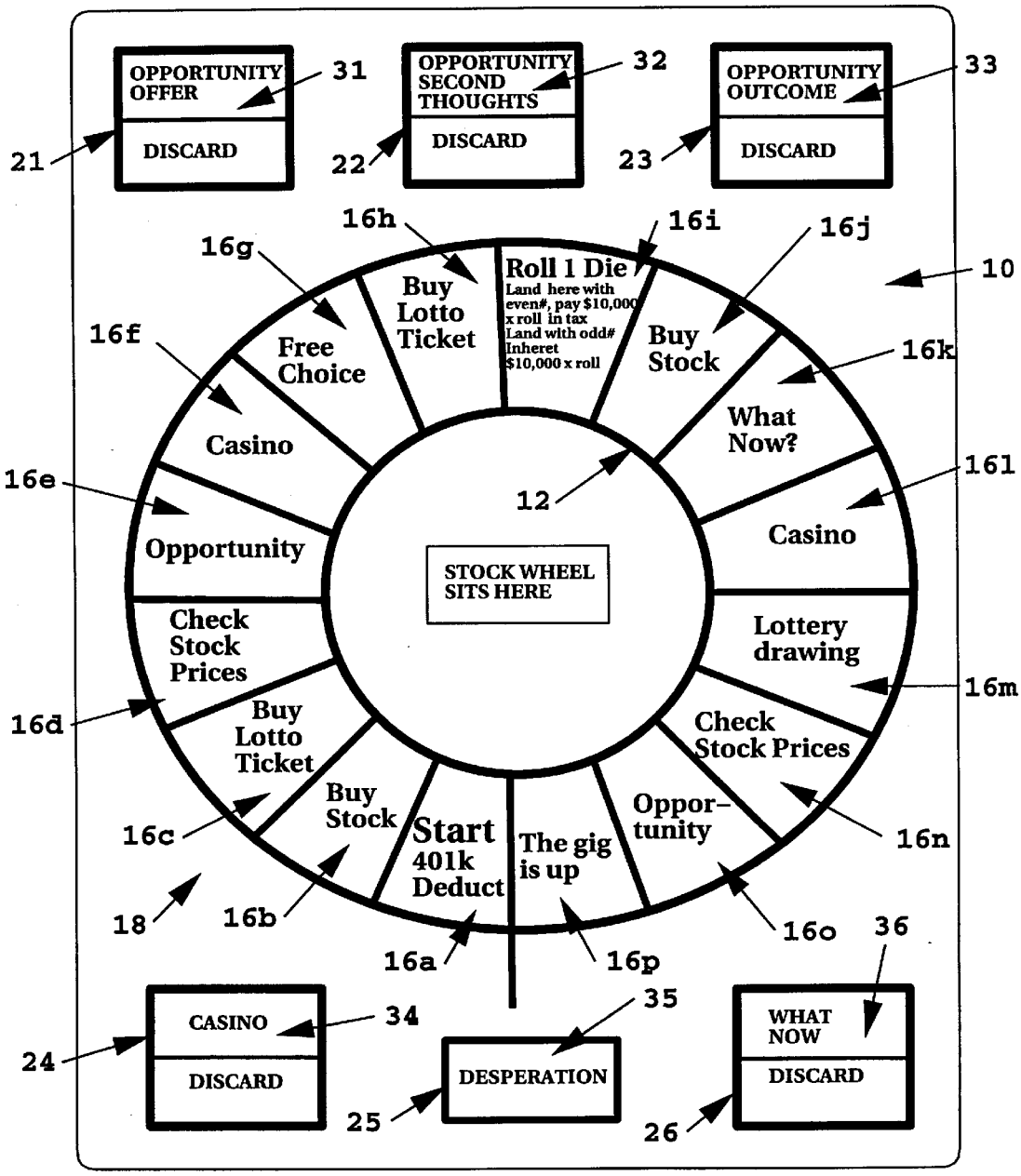
FIG. 1 is an illustration of the game board layout according to the principles of the present invention.
Figure 2:
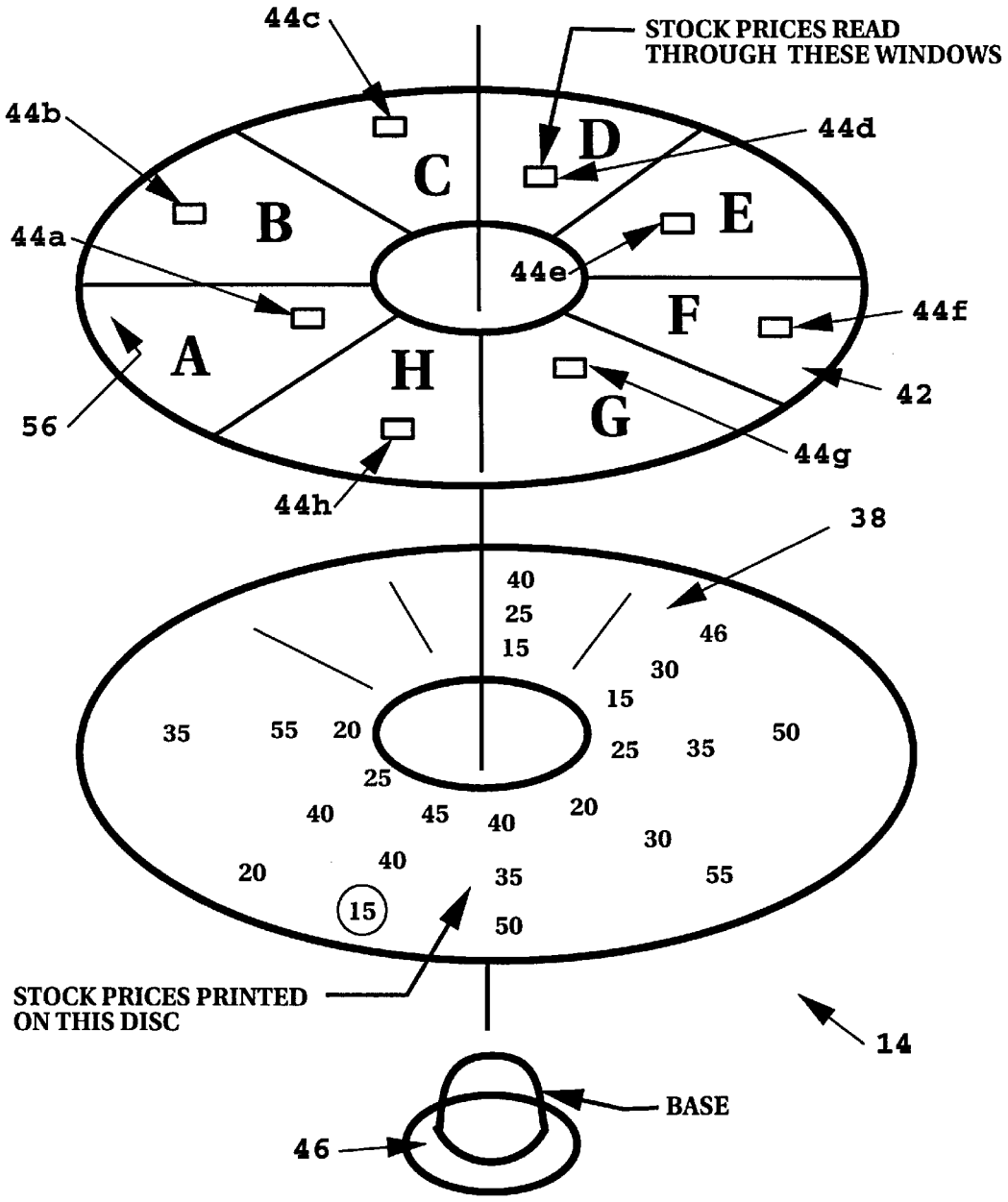
FIG. 2 is an exploded schematic view of the stock wheel according to the principles of the present invention.

FIG. 1 illustrate a game board 10 according to the principles of the present invention. The game board 10 is provided with a center circle 12 which is designed to receive a stock wheel 14 as shown in FIG. 2. Arranged about the center circle 12 is a border including a series of playing position 16*a*–16*p* forming a track about the center circle 12. Each playing position 16*a*–16*p* represent various financial situations and instructions which will be described in detail hereinafter. The game board 10 is provided with six outlined locations 21–26 for receiving six sets of cards 31–36. The six sets of cards 31–36 include "Opportunity Offer" cards 31, "Opportunity Second Thoughts" cards 32, "Opportunity Outcome" cards 33, "Casino" cards 34, "Desperation" cards 25, and "Now What" cards 36, each of which will be described in greater detail herein.

Stock wheel 14 which is designed to be placed in the center circle 12 of game board 10 includes a stock price disk 38 having stock prices printed thereon and a second disk 42 provided with a plurality of windows 44A–44H. A base 46 is provided for supporting the stock price disks as well as the second disk 42. The stock price disks 38 are provided with a plurality of numbers representing stock prices which are disposed at various radial distances from the center of the disks 38. In this way, each of the radial rings of stock prices correlate to a different window 44A–44H in the second disk 42.

Figure 3:
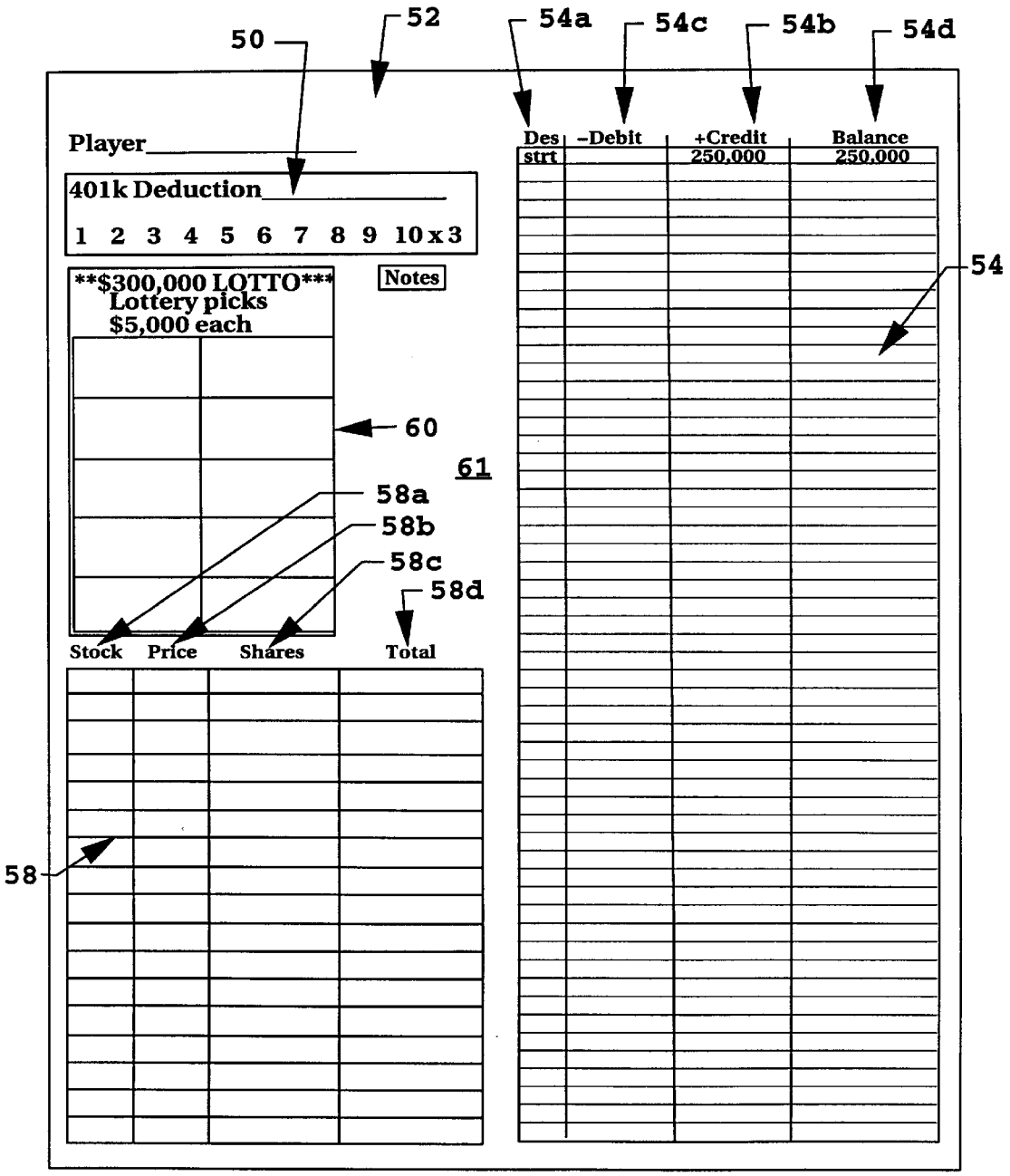
FIG. 3 is a score sheet for use with the game according to the principles of the present invention.

A preferred embodiment of the game includes the below list of equipment:

1. Game Board (FIG. 1)
2. Score Sheets
3. Standard Playing Cards (one deck)
4. Two Die
5. Rules
6. Cards
   - A) Opportunity Cards including:
     - a) Offer cards
     - b) Second Thoughts cards
     - c) Outcome cards
   - B) Casino cards
   - C) Now What? cards
   - D) Desperation cards
7. Stock Wheel and Stock Price Disks
8. Stock Prospectus
9. Casino Game Rules card
10. Game Tokens The preferred embodiment of the game is played according to the following rules:

The object of the game is to be the first to turn a predetermined amount of discretionary income such as $250,000 into an objective amount such as $1 million. This is done through various investment vehicles such as stocks, business deals, retirement savings, casino gambling, lottery, and inheritance. Players also may encounter expenses through taxes and assorted purchases. In the case of players becoming bankrupt, the winner is the last player having any remaining balance in their account. Players roll the dice and move their game piece around a circular board landing on playing positions that yield different investment options or expenditures. Before the game starts, players allocate their retirement saving (401K-type) contributions. The amount is entered in an allotted space 50 on each player's score sheet 52, as shown in FIG. 3. Each time the player passes the 401K deduction space (start) 16*a* on the game board 10, he debits his account on the balance sheet portion 54 of score sheet 52 and marks off the corresponding number of contributions in the 401K deduction box 50. After ten times around the board, the account matures to three times the total investment and is credited to the player's account on the balance sheet 54.

For example, Player 1 allocates $5,000 as his 401K deduction. His final credit is $5,000×10=$50,000 total contribution×3 (maturity rate)=$150,000 account balance.

A player may only cash out a 401K account after the account matures unless he falls on hardship or is forced to cash out by a "Now What?" card. Once the account matures or is cashed out, the account is closed. There is only one account per game.

In order to determine who will go first, the players roll the die. The highest roll starts. Once determined, the players rotate in a clockwise direction. The players carry out the transactions indicated on the corresponding space of the game board 10.

Buying and Selling Stocks

I. If a player lands on a "Buy Stock" space 16*b*, 16*j*, the player has the option to buy stock.

A. A stock portfolio is provided which includes a description and risk factor of each of the stocks A–H.

B. The player rotates the stock wheel to the next mark clockwise as indicated by the arrow 56. The stock purchase price per share is shown in each window 44A–44H of the second disk for each of the stocks A–H.

C. The player then decides which stock and number of shares he would like to purchase. (Players may choose only one stock per turn). The player also has the option to pass. A player may not purchase a stock with a red circle around the price which indicates a market crash. For Example, Player 1 buys $1,000 shares of Stock A at $10 per share: 1,000×10=$10,000. The Player debits his account $10,000 in the debit column 54*c* on the balance sheet 54 and records the stock purchase in the allocated space 58 on the score card 52. The Stock space 58 on the score card 52 records stock 58*a*, price per share 58*b*, number of shares 58*c*, and total costs 58*d*.

D. At this time, no other player may sell stock unless a stock price has a red circle around it. This indicates a "market crash". All players must sell all shares of all stocks indicated as such.

II. If any player lands on the Check Stock Prices playing position 16*n*, all players have the option to sell their stock.

A. When a player lands on the Check Stock Prices space 16*n* and stock is held by any player, the player turns the stock wheel 14 one mark clockwise.

B. At this time, all players have the option to sell at the indicated prices. If the stock price appears in red, this indicates a market crash. All players holding this stock must sell all shares at this price.

C. When selling stocks, each player multiplies the number of shares held by the price indicated on the wheel and credits their account balance portion 54 of score sheet 52 accordingly.

1. Once the stock is sold, the player crosses out the record of the stock indicating it has been sold.

D. If no stock is owned by the players, the wheel is not turned, and play continues with the next player.

Buy Lotto Ticket

If a player lands on a BUY LOTTO TICKET space 16*c*, 16*h*, he has the option to purchase a lottery ticket. The cost of a lottery ticket is $5,000. A winning ticket pays $300,000.

A. To purchase lottery ticket, a player debits his/her account $5,000 in the balance sheet portion 54 of score sheet 52 and chooses two numbers, each between 1 and 6. (For example, 2, 3).

B. The player then writes his choice in the lottery space 60 on score sheet 52.

C. A player may buy only one ticket each time the player lands on a Buy Lotto Ticket space 16*c*, 16*h*. The player may, however, accumulate as many tickets (number combinations) as possible per Lottery drawing.

Lottery Drawing

When any player lands on the Lottery Drawing space 16*m*, this affects all players holding lottery tickets. The player who lands on the Lottery Drawing space 16*m* rolls two die and the numbers that appear are then the winning numbers. All players holding the two number combination in any order, credit their account $300,000. Tickets are good for only one drawing. All players must cross out all numbers after each drawing.

Casino

When a player lands on one of the Casino spaces 16*f*, 16*l*, the player picks the top card on the Casino card pile 34. Each Casino card 34 designates a Casino-type game and the stakes to be played. The player states the amount of the stakes and begins. The games to be played include craps, blackjack, and draw poker.

I. Craps

A player rolls two die. On the first roll, numbers 2, 3, or 12 are losers and 7 or 11 are winners. All others: 4, 5, 6, 8, 9, and 10 become the point. The player must continue to roll the two die until the point is made for the second time. During this process, if the players rolls a 7, he loses and debits the account the predetermined amount. If the player wins, his account is credited.

II. Blackjack

The player gives the deck of cards to the player on the right who is now the dealer. The player states the amount of the bet. The dealer then deals cards first face up, second face down. The closest to 21 without going over wins. Face cards are worth 10, Aces are 11 or 1. If a player is dealt 21, he credits his account one and one half times the amount of the bet. The player is only playing against the dealer. The dealer must hit on 16 or lower. A player may hit (take another card) or stand at his discretion. Wins on other than a blackjack are paid off at 1:1. The basic rules are played unless players are knowledgeable in casino blackjack rules and want to use other variations.

Ill. Draw Poker

A player states the amount of the bet and the player to the right becomes the dealer. The player must beat the dealer for a win. Five cards are dealt, alternating to the player and dealer. The player, as well as the dealer, may discard up to three cards. The cards are then laid down to determine the winner.

Highest to Lowest

Royal Flush: Ace, King, Queen, Jack, and 10 of the same suit

Straight Flush: 5 card sequence same suit 4 of a kind: Any four of one type (e.g., 10s in each suit)

Full House: 3 of a kind plus one pair

Flush: All cards in same suit

Straight: 5 cards in sequence of any suit 3 of a kind 2 pair

Pair

High Card

Winning hand pays 1:1, and losses are the same. The player either debits or credits his account. The dealer does nothing.

Side Bets

Side bets are accepted by all other players up to half the amount of the initial bet. The side bet may go with or against the better. The player must state the amount of the side bet before casino play begins. All bet amounts can be recorded on the Notes area 61 of the score sheet to avoid conflicts after wins or losses. In card games, the dealer may only take a side bet against the player.

Opportunity

If a player lands on an Opportunity space 16*e*, 16*o*, the players picks up Offer card 31 which is the first in the Opportunity series.

I. Offer Card

The Offer card 31 is chosen first. The card describes an investment opportunity. If the player chooses to invest, he debits the amount on the score sheet 52 and takes the next Second Thoughts and Outcome card 32 and 33, respectively. The player is not allowed to look at these cards and they must remain face down.

II. Second Thoughts

When a player lands on an Opportunity space 16*e*, 16*o* again, the player may read the Second Thoughts card 32. The Second Thoughts card 32 will give a short sell opportunity to get out of the investment. The player can agree to the terms of the Second Thoughts card 32 or hold out and his turn is over.

III. Outcome

When a player lands on an Opportunity space 16*e*, 16*o* for the third time, the player can read the Outcome card 33. The card will describe the outcome of the initial investment. The player should follow the instruction on the card and credit or debit his account accordingly on the score sheet 52.

Now What?

When a player lands on the Now What? space 16*k*, the player must choose the top card 36 and follow the instructions. The player credits or debits his account accordingly on the score sheet 52.

Tax/Inheritance

If a player lands on the Tax/Inheritance space 16*i*, the player follows the instructions which read "Roll 1 Die, Land here with even #, pay $10,000 times roll in tax, land with odd #, inherit $10,000×roll". The player credits or debits his account according to the instructions.

Hardship

When a player runs into an expense and does not have enough money remaining to cover it, he must do one or more of the following before taking a desperation card 35.

A. Sell Stock

Player may check stock wheel once and sell all or part of stock holdings, but enough to cover the expense. The player in hardship is the only player who may sell stock at this time (unless a market crash appears).

B. Cash in 401K

Due to hardship, a player may cash in at 50% of the accrued value of the 401K contributions. For example, a player who allocated a $10,000 contribution and who has been around the board six times. 10,000×6=$60,000×50%=$30,000 to be credited to the player's account.

Desperation

When a player runs out of money or does not have enough to cover an expense, the player must first go through the steps of hardship mentioned above. If this does not cover the expenses, the player may then choose a Desperation card 35 and follow the instructions. The Desperation cards 35 will describe a desperate act that has been committed and the resulting financial gain. The player must retain the card. The player uses the funds to settle all financial debts. The bottom half of the card states the penalty payable only if the player lands on "The Gig Is Up" space 16*p*. The players are entitled to one desperation card per game.

Gig Is Up

If a player lands on "The Gig Is Up" space 16*p* and he is holding a Desperation card 35, he must follow the penalty instructions described on the card.

Winning

The game is over when the first player reaches a one million dollar balance in their account. Once a player declares he/she has reached a balance of $1 million in his/her account, that individual is done with all transactions. The play then goes around one more time giving all other players one last change at any unfinished business. Once this is done, the player with the highest account balance wins. Note: This is balance in account not net worth. For example, a player may have stock holdings worth $50,000 but they are tied up in the market, not cashed out and therefore worth zero.

If a player exhausts Hardship and Desperation cards 35 and still goes bankrupt, he loses. If this happens to many players, the winner may be the last one with an account balance.

Variations of Game

Rather than players trying to reach one million dollars, players may agree to a specified number of times around the board or another objective dollar amount. In addition, players may also agree to modify the number of times around the board necessary for 401K account maturity.

Keeping Score

Players keep score similar to a checking account register. The balance sheet portion 54 of score sheet 52 includes a column 54*a* designated DES which is for a brief description of the entry. For example, Lottery (Lot.). These players mark credits and debits in the columns 54*b*, 54*c*, respectively, and keeping a running balance in column 54*d*. Players may audit one another at any time.

Penalties

Any players caught tampering with the stock wheel are charged with insider trading and are fined $100,000 and banned from stock trading for the rest of the game. Any player looking ahead at Opportunity Cards (Second Thoughts or Outcome) must turn in all cards and debit account twice the initial investment in penalties.

Any player may audit another player's account at any time during the game. Any discrepancies found during an audit must be corrected immediately.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A board game comprising:

a game board having a track thereon with a series of playing positions, said playing positions representing various financial situations;

a plurality of game pieces for movement by respective players along said track;

chance means for use by the players in turn to determine how far a player's game piece is to be moved after each turn of said player with said chance means; and a set of cards which each include a financial gain obtained by an act that had been committed, said cards also providing a consequence associated with said act that a player must incur if the player lands on a predetermined one of said playing positions.

2. The board game according to claim 1, wherein said series of playing positions includes at least one lottery play position and at least one lottery draw position, said lottery play position providing a player who lands thereon an opportunity to purchase a lottery number for a chance at winning a prize jackpot, said lottery draw position representing a lottery drawing for all players who purchased a lottery number.

3. The board game according to claim 1, wherein said series of playing positions including at least one position for providing a player with an option for buying stocks, a purchase price for said stocks being provided on a stock wheel;

said series of playing positions further including at least one position for providing all players an option for selling stocks, a sale price for said stocks being provided on said stock wheel.

4. The board game according to claim 1, wherein said series of playing positions including at least one position for providing a player with an opportunity to play a casino-type game.

5. The board game according to claim 1, wherein said playing positions include at least one position with at least two corresponding sets of cards, a first set of cards each describe different investment opportunities and a second set of cards each describe an outcome of an initial investment, wherein a player who lands on said at least one position takes a card from said first set of cards and if said player purchases the investment opportunity, the player takes a card from said second set of cards and said player must wait until subsequently landing on a designated position in order to determine the outcome of an initial investment.

6. The board game according to claim 1, wherein each player designates a contribution amount for contributing to a savings account each time the player passes a predetermined position on said game board, after a predetermined number of passes around said game board said savings account matures to a predetermined multiple of a total contribution amount.

* * * * *